US012449196B2

(12) United States Patent
Sese Monclus et al.

(10) Patent No.: US 12,449,196 B2
(45) Date of Patent: Oct. 21, 2025

(54) CRYOCOOLER SUITABLE FOR GAS LIQUEFACTION APPLICATIONS, GAS LIQUEFACTION SYSTEM AND METHOD COMPRISING THE SAME

(71) Applicants: Consejo Superior de Investigaciones Cientificas (CSIC), Madrid (ES); Universidad de Zaragoza, Saragossa (ES)

(72) Inventors: Javier Sese Monclus, Saragossa (ES); Conrado Rillo Millan, Madrid (ES)

(73) Assignees: Consejo Superior de Investigaciones Cientificas (CSIC), Madrid (ES); Universidad de Zaragoza, Saragossa (ES)

( * ) Notice: Subject to any disclaimer, the term of this patent is extended or adjusted under 35 U.S.C. 154(b) by 0 days.

(21) Appl. No.: 18/636,970

(22) Filed: Apr. 16, 2024

(65) Prior Publication Data

US 2024/0263872 A1 Aug. 8, 2024

Related U.S. Application Data

(63) Continuation of application No. 17/056,171, filed as application No. PCT/EP2019/062838 on May 17, 2019, now abandoned.

(30) Foreign Application Priority Data

May 17, 2018 (EP) ..... 18382340

(51) Int. Cl.

| | |
|---|---|
| ***F25J 1/02*** | (2006.01) |
| ***F25B 9/10*** | (2006.01) |
| ***F25J 1/00*** | (2006.01) |

(52) U.S. Cl.
CPC ..... *F25J 1/0203* (2013.01); *F25B 9/10* (2013.01); *F25J 1/0047* (2013.01); *F25J 1/0254* (2013.01);
(Continued)

(58) Field of Classification Search
CPC ..... F25J 1/0203; F25J 1/0047; F25J 1/0254; F25J 2215/32; F25J 2215/30;
(Continued)

(56) References Cited

U.S. PATENT DOCUMENTS 3,914,950 A 10/1975 Fletcher
5,697,219 A 12/1997 Nagao
(Continued)

FOREIGN PATENT DOCUMENTS

CN 105675381 A 6/2016
CN 106524554 A * 3/2017 ..... F25B 9/14
(Continued)

OTHER PUBLICATIONS

CN-106524554-A English Translation (Year: 2017).*
(Continued)

*Primary Examiner* — Frantz F Jules
*Assistant Examiner* — Devon Moore
(74) *Attorney, Agent, or Firm* — Hayes Soloway P.C.

(57) ABSTRACT

The present invention relates to a cryocooler suitable for gas liquefaction applications, that comprises a coldhead with one or more refrigeration stages; further comprising: a refrigerator compressor for distributing compressed gas-phase cryogen inside the coldhead; a heat exchanging coil arranged at least partially around the external region of the coldhead; at least one extraction orifice communicating a gas circulation circuit inside the coldhead with the heat exchanging coil; acting said extraction orifice/s as pass-through port/s which allow the gas inside the coldhead to
(Continued)

flow through the inside of the heat exchanger coil for exchanging heat with the exterior thereof, and wherein the heat exchanging coil is adapted to connect and redirect the gas to one return port connected to the gas circulation circuit. Another object of the invention relates to a cryogen-gas liquefaction system and a method for liquefaction of gases that comprises said system.

18 Claims, 4 Drawing Sheets

(52) U.S. Cl.
CPC ..... *F25J 2215/32* (2013.01); *F25J 2270/912* (2013.01); *F25J 2280/00* (2013.01); *F25J 2290/62* (2013.01)

(58) Field of Classification Search
CPC .. F25J 2215/50; F25J 2215/42; F25J 2270/91; F25J 2270/912; F25J 2280/00; F25J 2290/62; F25J 2215/10; F25J 1/0005; F25J 1/0007; F25B 9/10; F25B 9/14
See application file for complete search history.

(56) References Cited

U.S. PATENT DOCUMENTS

| | | | |
|---|---|---|---|
| 8,671,698 | B2 | 3/2014 | Wang |
| 2007/0261418 | A1 | 11/2007 | Nun |
| 2013/0014517 | A1 | 1/2013 | Diederichs et al. |
| 2017/0370638 | A1 | 12/2017 | Millan et al. |

FOREIGN PATENT DOCUMENTS

| | | | | | |
|---|---|---|---|---|---|
| EP | 3260801 | A1 | | 12/2017 | |
| GB | 2430023 | A | * | 3/2007 | ..... F17C 13/007 |
| JP | 2018506173 | A | | 3/2018 | |
| WO | 2011139989 | A2 | | 11/2011 | |
| WO | 2019146214 | A1 | | 8/2019 | |

OTHER PUBLICATIONS

C. Wang, "A Compact Cold Helium Circulation System with GM Cryocooler", Article, 2014, 545-550, vol. 18, Cryocoolers, International Cryocooler Conference.

* cited by examiner

CRYOCOOLER SUITABLE FOR GAS LIQUEFACTION APPLICATIONS, GAS LIQUEFACTION SYSTEM AND METHOD COMPRISING THE SAME

CROSS-REFERENCE TO RELATED APPLICATIONS AND PRIORITY

This patent application is a continuation of U.S. patent application Ser. No. 17/056,171 filed on Nov. 17, 2020, which claims priority from PCT Application No. PCT/EP2019/062838 filed May 17, 2019, which claims priority from European Patent Application No. 18382340.0 filed May 17, 2018. Each of these patent applications are herein incorporated by reference in their entirety.

FIELD OF THE INVENTION

The present invention relates generally to systems and methods that employ small-scale cryogenic refrigerators, and more particularly to cryocoolers employed for the liquefaction of gases. The main field of application of the invention is helium liquefaction technologies such as small-scale liquefiers of <100 liter/day liquefaction rates, based on closed-cycle cryocooler devices.

BACKGROUND OF THE INVENTION

Helium is a scarce element on earth and its numerous scientific and industrial applications continue to drive a growing demand. For example, common uses of gas-phase helium include welding, lifting (balloons), and semiconductor or fiber optic manufacturing. In the liquid phase, common uses include refrigeration of certain medical and scientific equipment, purging fuel tanks and basic research in solid-state physics, magnetism, and a wide variety of other research topics. Because of the widespread utility of helium and its limited availability, it is considered a high-cost non-renewable resource. Accordingly, there is an increasing interest in recycling helium and other similar noble gases.

In particular, liquid helium is used as the refrigerant in many applications in which it is necessary to reach temperatures below 20 K. Such applications are frequently related to the use of superconductors, and particularly in low-temperature physics research equipment, which operates in evacuated and insulated containers or vacuum flasks, called Dewars or cryostats. Such cryostats contain a mixture of both the gas and liquid phases and, upon evaporation, the gaseous phase is often released to the atmosphere. Therefore, it is often necessary to purchase additional helium from an external source to continue the operation of the equipment in the cryostat.

One of liquid helium's most important applications is to refrigerate the high magnetic field superconducting coils used in magnetic resonance imaging (MRI) equipment, which provides an important diagnostic technique by non-invasively creating images of the internal body for diagnosing a wide variety of medical conditions in human beings.

Large scale (Class L) industrial helium liquefaction plants typically produce more than 100 liters/hour and require input power of more than 100 KW. For laboratories with more moderate consumption, medium (Class M) liquefaction plants are available that produce about 15 liters/hour. These large and medium liquefaction plants achieve a performance, R, of about 0.5-1 liter/hour/kW (12-24 liters/day/KW) when the gas is pre-cooled with liquid nitrogen, and about 0.25-0.5 liters/hour/KW (6-12 liters/day/KW) without pre-cooling.

For smaller scale applications, small-scale refrigerators are now commercially available which are capable of achieving sufficiently low temperatures to liquefy a variety of gases and, in particular, to liquefy helium at cryogenic temperatures below 4.2 K. In the industry, these small-scale refrigerators are normally referred to as closed-cycle cryocoolers. These cryocoolers have three components: a coldhead (a portion of which is called the "cold finger" and typically has one or more refrigeration stages), where the coldest end of the cold finger achieves very low temperatures by means of the cyclical compression and expansion of helium gas circulating inside the coldhead; a helium compressor which provides high pressure helium gas to and accepts lower pressure helium gas from the coldhead; and high and low pressure connecting hoses which connect the coldhead to the helium compressor. Each of the one or more cooling stages of the cold finger has a different diameter to accommodate variations in the properties of the helium fluid at various temperatures. Each stage of the cold finger comprises an internal regenerator and an internal expansion volume where the refrigeration occurs at the coldest end of each stage.

Cryocoolers are examples of cryogenic refrigerators able to generate extremely low temperatures using thermodynamic cycles. In order to achieve said temperatures, cryocoolers are configured so as to appropriately synchronize periodic pressure fluctuations in the expansion space with periodic variation in volume of the expansion space due to the reciprocating movement of a displacer.

For the majority of the applications, a cryocooler coldhead is in vacuum and the devices to be refrigerated are thermally anchored to the cooling stations of the coldhead stages (cold fingers). Due to the non-ideality of the regenerators, there is extra cooling power that is not used when the coldhead is in vacuum and the refrigerated devices attached to the cold fingers. Moreover, in certain applications in which the coldhead is not in vacuum but in a gas atmosphere (e.g. gas re-condensers and gas liquefiers) only a small fraction of such extra cooling power available at the regenerators can be recovered and used. Accordingly, there is a need of novel solutions allowing the extraction of the extra cooling power of the regenerators.

As a further advantage of the recovering of the extra cooling power, it must be noted that an improvement of the so called "small scale liquefiers" could be achieved. In these liquefiers, the gas to be liquefied cools by thermal exchange with either the cold stages of the cryocooler, or with heat exchangers attached to the cold stages of the cryocooler. In these small-scale liquefiers, a cryocooler coldhead operates in the neck of a double-walled container (a Dewar), which contains only the gas to be liquefied and is thermally insulated to minimize the flow of heat from the outside to the inside of the container. After the gas condenses, the resulting liquid is stored inside the inner tank of the Dewar. Typically, the achievable liquefaction performance (in terms of liters/day/KW) is significantly less for these small-scale liquefiers (<4 liters/day/kW) than the performance obtained with the larger Class M and Class L liquefaction plants (>6-12 liters/day/KW).

As a result of the development of these cryocoolers, various small-scale ("class S") liquefaction systems have become commercially available in the last years, such as for example the system disclosed in patent application WO 2011/139989 A2 or the system disclosed in U.S. Pat. No. 8,671,698 B2.

An improved system for helium liquefaction is described in patent application EP 3260801 A1. This system allows part of the helium that circulates inside the coldhead flowing to the exterior thereof, through one or more orifices in the coldest region of the same. This helium (which typically exits the coldhead at 4K temperature) contributes to the liquefaction rate of helium through an exchange of matter, in this case by extracting small volumes of cooled gas in the liquefaction region of the system. To compensate for the loss of gas from the coldhead internal circuit, other elements are introduced into the system for introducing high purity helium gas into the compressor, to compensate the gas flowing out of the coldhead. However, even though this system improves liquefaction efficiency over other known alternatives, it also introduces new complexities when it comes to manufacturing and, above all, maintaining the system in operation, which makes the process of liquefaction of helium more expensive due to its dependence on a high purity helium source.

Recently, another refrigeration system comprising orifices in a coldhead has been devised and is described, for instance, in the scientific publication by C. Wang et al., "*A compact cold helium circulation system with GM cryocooler", in 18th International Cryocooler Conference ICC, Syracuse* (2014). In such system, an isolated transfer line is connected to an orifice in the coldhead that provides heat transfer therefrom to another external coldfinger in order to profit a small amount of the cooling power coming from the coldhead. The final purpose is to get a new cold helium circulation system that features a compact size, lower vibration, and lower cost than the existing cold helium circulation system. In this case, the solved technical problem is very different from the one that tries to extract the extra cooling power from the coldhead intended for the same cryocooler.

The present invention proposes a novel cryocooler which improves the efficiency in the extraction of the extra cooling power available due to the non-ideality of the regenerators in closed cycle cryocooler-based systems and for the profiting in the same cryocooler, with the difference that it does not require a great added complexity, avoiding the aforementioned exchange of matter, being based in a purely thermal exchange instead.

BRIEF DESCRIPTION OF THE INVENTION

The object of the present invention relates, without limitation, to the development of a cryocooler suitable for gas liquefaction applications, comprising:

- a coldhead with one or more refrigeration stages;
- a refrigerator compressor for distributing compressed cryogen gas inside the coldhead acting as refrigeration means for lowering the temperature of the refrigeration stages of the coldhead, wherein said cryogen gas is supplied to and returned from the coldhead through a gas circulation circuit comprising input and output gas lines connecting the coldhead to the refrigerator compressor;
- at least one extraction orifice communicating the gas circulation circuit inside the coldhead with the external region of the refrigeration stages, acting as a pass-through port which allows the gas inside the coldhead to flow to the exterior thereof.

Advantageously, the coldhead further comprises a heat exchanging coil arranged at least partially around the external region of the coldhead, wherein the heat exchanging coil is connected at one end to the gas circulation circuit through the extraction orifice, and at other end to one return port connected to the gas circulation circuit. A "coil" configuration will be understood as any geometry of helix, spiral or spring form, intended for providing an enhanced heat exchange surface at least partially along the extension of the coldhead from the extraction orifice to the connection with the return port connected to the gas circulation circuit. However, other geometrical configurations different to those forms and intended for the same purpose will be also understood to be included into this definition, according to the object of the invention.

Through this configuration, the cryocooler of the invention extracts cold cryogen gas (and therefore extra cooling power) from the interior of the coldhead and allows it to exchange thermal energy with the exterior thereof, by means of the heat exchanging coil. Thus, the cryocooler enhances the cooling power of the refrigerator compared to other known cryocoolers of the prior art.

Also, since the heat exchanging coil connects the extraction orifice of the coldhead with the return port connected to the gas circulation circuit, the heat is transferred to the exterior of the coldhead without mass exchange, and the gas extracted from one of the stages of the coldhead is returned to the coldhead or to the compressor by its closed connection to the gas circulation circuit of the cryocooler through the return port. This advantageously allows, for instance, avoiding the use of external sources of high-purity gas to the gas circulation circuit, which are required in other known cryocoolers as the one disclosed in EP 3260801 A1.

In a preferred embodiment of the present invention, the one or more extraction orifices are performed over one or more refrigeration stages of the coldhead, and attached thereto through fixing means comprised in the pass-through ports, optionally in combination with insulating seals to prevent undesired gas flow through said fixing means.

In yet another preferred embodiment of the present invention, one or more pass-through ports comprise one or more configurable cryogenic flow valves. Preferably, the one or more cryogenic flow valves are check valves. Preferably, the pass-through ports and the one or more cryogenic flow valves are connected through a capillary tube.

In yet another preferred embodiment of the invention, the connection between the heat exchanging coil and the return port connected to the gas circulation circuit comprises a mass flow controller valve and/or an insulating seal.

In yet another preferred embodiment of the invention, the return port is disposed at the output gas line of the gas circulation circuit.

In yet another preferred embodiment of the present invention, the cryogen gas within the compressor is helium.

In yet another preferred embodiment of the present invention, the extraction orifices have a diameter of 0.5-5.0 mm.

In yet another preferred embodiment of the present invention, the heat exchanging coil is made of a metal element or metallic alloy, preferably comprising copper.

Preferably, the heat exchanging coil is arranged around the external region of all the one or more refrigeration stages of the coldhead.

In yet another preferred embodiment of the present invention, the coldhead comprises two or more refrigeration stages, at least a (warmer) first refrigeration stage and a (cooler) second refrigeration stage.

Preferably, the heat exchanging coil is arranged only around the external region of the second refrigeration stage of the coldhead.

In yet another preferred embodiment of the present invention, the return port is disposed at the coldhead. Preferably, in the embodiments where the coldhead comprises two refrigeration stages, the return port is disposed at the first refrigeration stage of the coldhead and, more preferably, at the end of the first refrigeration stage of the coldhead. In this manner, the main extra cooling power inside the second refrigeration stage is exploited.

In yet another preferred embodiment of the present invention, the return port is disposed at the return gas line between the coldhead and the refrigerator compressor.

In yet another preferred embodiment of the present invention, the cryocooler further comprises a thermally insulating layer disposed between the heat exchanging coil and the external region of the coldhead. In this manner, the cool inside the coldhead is mainly used in cooling the gas at the interior thereof and, at the same time, the enthalpy of the gas circulating inside the heat exchanger coil is mainly transferred to the gas at the exterior thereof through a very efficient thermal exchange.

Preferably, in the embodiments where the coldhead comprises two refrigeration stages, said thermally insulating layer is arranged only around the external region of the second refrigeration stage. In this manner, the application of the cooling power of the second refrigeration stage is better controlled.

Alternatively, in the embodiments where the coldhead comprises two refrigeration stages, said thermally insulating layer is arranged only around the external region of the first refrigeration stage.

Alternatively, in the embodiments where the coldhead comprises two refrigeration stages, said thermally insulating layer is arranged around the external region of the first and second refrigeration stages.

In yet another preferred embodiment of the present invention, the heat exchanging coil is connected to the extraction orifice and/or to the return port through one or more of the following elements: one or more cryogenic flow valves, a mass flow controller, a volume controller, a capillary tube, an insulating seal and/or or one or more joints.

Preferably, the cryogenic flow valves are mechanic check valves. In this manner the flow of gas through the heat exchanging coil goes only in one desired direction.

A further object of the present invention is a gas liquefaction system comprising a cryocooler according to any of the embodiments described herein. This liquefaction system is adapted to utilize the thermodynamic properties of gaseous elements to extract increased cooling power from the cryocooler, improving the liquefaction rate and performance compared to the already known cryocooler liquefaction systems.

The liquefaction system of the invention comprises a cryostat or Dewar comprising a liquefaction region wherein the coldhead of the cryocooler is housed. The liquefaction region is defined as a volume within the Dewar including a first cooling region adjacent to a first stage of the cryocooler, where external gas entering the Dewar is initially cooled, and a second condensation region adjacent to a second or subsequent stage of the cryocooler where the cooled gas is further cooled and condensed into a liquid-phase. Thus, for purposes of this invention, the liquefaction region includes the neck portion of the Dewar and extends to the storage portion where liquefied cryogen is stored. In various embodiments of the invention, the system further comprises means for controlling pressure inside the Dewar, which can include a unitary pressure control module being adapted to regulate an input gas flow for entering the liquefaction region, such that pressure within the liquefaction region is precisely maintained during a liquefaction process. Alternatively, a series of pressure control components selected from solenoid valves, a mass flow meter, pressure regulators, and other pressure control devices may be individually disposed at several locations of the system such that a collective grouping of the individualized components is adapted to provide control of an input gas entering into the liquefaction region of the system.

Moreover, in order to further optimize the heat exchange between the gas and the various refrigeration elements of the liquefaction system, the proposed invention takes advantage of the already cooled gas circulating inside the coldhead of the cryocooler, by extracting small volumes of said gas from the coldest part of the coldhead, without altering its functioning. This already cold gas flows through the heat exchanging coil connected to the extraction orifices and exchanges heat with the external gas of the Dewar which is to be cooled at the liquefaction and condensation regions. Since the gas circulating inside the coil exits the coldhead at very low temperature, it enhances the liquefaction rate of the system over its trajectory between the extraction orifice and the connection with the return port connected to the internal gas circulating circuit, while avoiding gas exchange between the coldhead and the Dewar.

The aforementioned liquefaction improvements are thus achieved by a liquefaction system for liquefying cryogen gas preferably comprising:

- a storage container comprising a liquid storage portion and a neck portion extending therefrom, the liquid storage portion being adapted to contain a liquefied gas bath at the bottom of the storage container and comprising a liquefaction region above said bath, wherein the gas to be liquefied exchanges heat with the liquefaction system;
- a cryocooler according to the present invention, whose coldhead is arranged at the neck portion of the Dewar.

In a preferred embodiment of the invention, the liquefaction system further comprises a pressure control mechanism for controlling the cryogen gas pressure within the liquefaction region of the storage container. More preferably, the pressure control mechanism comprises a pressure sensor for measuring the pressure values within the liquefaction region of the storage container.

In yet another preferred embodiment of the present invention, the pressure control mechanism is further connected to a Programmable Logic Controller (PLC) adapted for dynamically modulating input gas flow and/or pressure within the liquefaction region of the storage container.

In yet another preferred embodiment of the present invention, the cryogen-gas liquefaction system further comprises a gas source module containing an amount of gas-phase cryogen for its introduction into the liquefaction region of the storage container.

In yet another preferred embodiment of the present invention, the cryogen-gas liquefaction system further comprises a level meter for measuring the volume of liquid within the storage container.

In yet another preferred embodiment of the present invention, the storage container further comprises a transfer port extending from the liquid storage portion to an external surface of the storage container.

In yet another preferred embodiment of the present invention, the cryogen gas within the storage container is any of: helium, nitrogen, oxygen, hydrogen or neon.

In yet another preferred embodiment of the present invention, the gas contained in the gas intake module is high purity helium gas, recovered and/or purified from a helium-using equipment.

The system according to the present invention is adapted to maintain precise control over the vapor pressure inside the container, and thus is adapted to maintain precise control of the temperature and hence the power of the cryocooler where condensation is produced. Consequently, the system allows control of the operating point of the cryocooler, as determined by the temperatures of its one or more stages, and, thereby, of the amount of heat that can be extracted by the gas being liquefied, both for its pre-cooling from room temperature to the point of operation, and for its condensation and liquefaction.

In a preferred embodiment of the present invention, the storage container is insulated by a shell with the volume within the shell external of the storage portion being substantially evacuated of air.

In yet another preferred embodiment of the present invention, the storage container further comprises a transfer port extending from the liquid storage portion to an external surface of the storage container.

In yet another preferred embodiment of the present invention, the system further comprises a gas source module containing an amount of gas-phase cryogen for its introduction into liquefaction region of the storage container.

In yet another preferred embodiment of the present invention, the system further comprises a level meter for measuring the volume of liquid within the storage container.

In yet another preferred embodiment of the present invention, the pressure control mechanism comprises one or more of the following components:

a pressure sensor for measuring the pressure values within the liquefaction region of the storage container;

a pressure regulator for regulating pressure of gas entering the liquefaction region of the storage container;

a mass flow meter;

one or more valves for regulating input gas flow entering the liquefaction region.

In yet another preferred embodiment of the present invention, the pressure control mechanism is further connected to a computer for dynamically modulating input gas flow and/or pressure within the liquefaction region of the storage container.

Another aspect of the invention relates to a gas liquefaction method that makes use of the gas liquefaction system disclosed in the present application, which comprises a cryocooler as disclosed in the present application and also comprises the following steps:

(i) providing at least:

a storage container having a liquefaction region and defined by a storage portion and a neck portion extending therefrom;

a pressure control mechanism for controlling the pressure within the liquefaction region of the storage container;

a cryocooler's coldhead at least partially disposed within the neck portion, the coldhead being adapted to condense cryogen contained within the liquefaction region from a gas-phase to a liquid-phase;

wherein the cryocooler's coldhead comprises:

a refrigerator compressor for distributing cold compressed gas-phase cryogen inside the coldhead; wherein said cryogen gas is supplied to and returned from the coldhead through a gas circulation circuit comprising input and output gas lines connecting the coldhead to the refrigerator compressor;

at least one extraction orifice communicating the gas circulation circuit inside the coldhead with the external region of the refrigeration stages, acting as a pass-through port which allows the gas inside the coldhead to flow to the exterior thereof;

a heat exchanging coil arranged at least partially around an external region of the coldhead, wherein the heat exchanging coil is connected at one end to the gas circulation circuit through the extraction orifice, and at other end to a return port connected to the gas circulation circuit;

a PLC connected to the refrigerator compressor for controlling the pressure within the coldhead;

(ii) measuring and controlling the vapor pressure within said liquefaction region of the storage container with the pressure control mechanism and the PLC, and the internal pressure within the coldhead with the PLC;

(iii) maintaining the vapor pressure within said liquefaction region of the storage container by means of the pressure controller, and maintaining the internal pressure within the coldhead within an operating range by means of the PLC.

In a preferred embodiment of the present invention, the proposed gas liquefaction method further comprises the step of injecting gas into the liquefaction region of the storage container with a gas source, in collaboration with the pressure controller of the storage container, for maintaining the vapor pressure during step (iii).

In sum, the cryocooler proposed for closed cycle regenerative refrigerators by the present invention allows an optimal extraction and profiting of the extra cooling power of the refrigerator that is available due to the non-ideality of the regenerator.

In addition, the gas liquefaction system and method proposed by the present invention achieve much higher efficiencies than existing cryocooler-based liquefiers by providing improved heat exchanging means between the gas and the various refrigeration elements of the liquefaction system, extracting small volumes of said gas from the coldhead and making it circulate through a heat exchanger coil around the coldhead, so a heat exchange is produced in the liquefaction region of the storage container. The liquefaction efficiency of the system is further enhanced and stabilized by precisely controlling the pressure of the room temperature gas entering the liquefaction region, and thereby precisely controlling the pressure of the condensing gas in the liquefaction region of the system.

BRIEF DESCRIPTION OF THE DRAWINGS

The features and advantages of this invention will be apparent from the following detailed description, when read in conjunction with the accompanying drawings, in which.

NUMERICAL REFERENCES USED IN THE DRAWINGS

Figure 1:
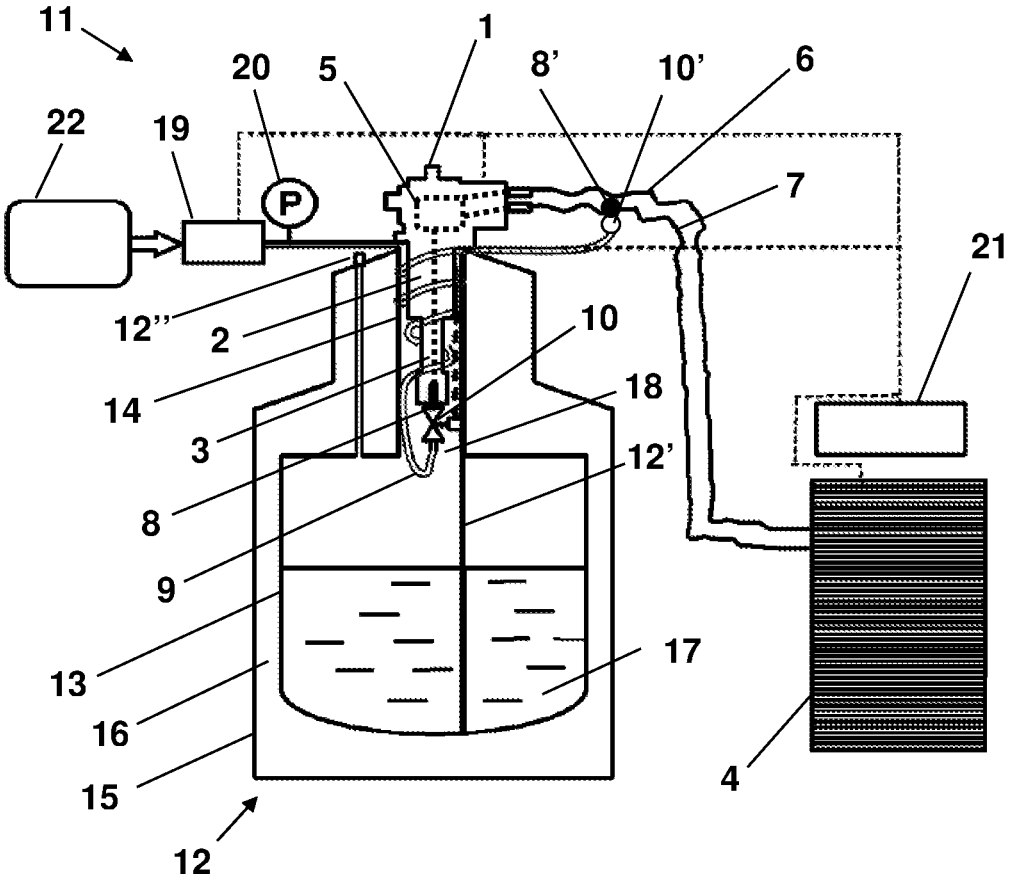
FIG. 1 shows a schematic diagram of a preferred embodiment of the cryocooler and the gas liquefaction system according to the invention.

In order to provide a better understanding of the technical features of the invention, FIGS. 1-7 are accompanied of a series of numeral references which, with illustrative and non limiting character, are hereby represented:

| | |
|---|---|
| (1) | Coldhead |
| (2, 3) | Refrigeration stages |
| (2', 3') | Insulating layer |
| (4) | Refrigerator compressor |
| (5) | Gas circulation circuit |
| (6) | Gas input line |
| (7) | Gas output line |
| (8) | Extraction orifice |
| (8') | Return port |
| (9) | Heat exchanging coil |
| (10) | Cryogenic valves |
| (10') | Mass flow controller |
| (10'') | Control volume |
| (11) | Liquefaction system |
| (12) | Storage container |
| (12') | Level meter |
| (12'') | Transfer port |
| (13) | Liquid storage portion |
| (14) | Neck portion |
| (15) | Outer vessel |
| (16) | Shell |
| (17) | Liquefied gas bath |
| (18) | Liquefaction region |
| (19) | Pressure control mechanism |
| (20) | Pressure sensor |
| (21) | Programmable Logic Controller (PLC) |
| (22) | Gas source module |

DETAILED DESCRIPTION OF THE DRAWINGS

In the following description, for purposes of explanation and not limitation, details are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

In a general embodiment according to FIGS. 1-7, the cryocooler according to the invention comprises:

- a coldhead (1) equipped with one or more refrigeration stages (2, 3); preferably comprising a first stage (2) and a second stage (3);
- a refrigerator compressor (4) for distributing compressed gas-phase cryogen inside the coldhead (1), wherein said cryogen gas is supplied to and returned from the coldhead (1) and acts as refrigeration means for lowering the temperature of the one or more refrigeration stages (2, 3) of said coldhead (1);
- a refrigerator compressor (4) for distributing compressed cryogen gas inside the coldhead (1) and acting as refrigeration means for lowering the temperature of the refrigeration stages (2, 3) of the coldhead, wherein said cryogen gas is supplied to and returned from the coldhead (1) through a gas circulation circuit (5) comprising gas input (6) and output (7) lines connecting the coldhead (1) to the refrigerator compressor (4);
- at least one extraction orifice (8) communicating the gas circulation circuit (5) inside the coldhead (1) with the external region of the refrigeration stages (2, 3), acting as a pass-through port which allows the gas inside the coldhead (1) to flow to the exterior thereof.
- a heat exchanging coil (9) arranged at least partially around the external region of the coldhead (1), wherein said heat exchanging coil (9) is connected at one end with the gas circulation circuit (5) through the at least one extraction orifice (8), and at other end to a return port (8') connected to the gas circulation circuit (5).

Figure 2:
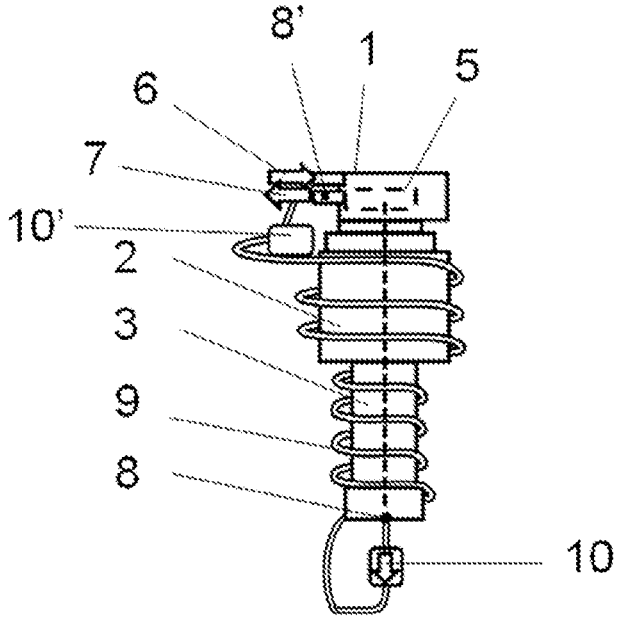
FIG. 2 shows a schematic diagram of a preferred embodiment of the cryocooler, wherein the heat exchanging coil is arranged around all the refrigeration stages of the coldhead, with the return port at the gas output line, according to the invention.

In a particular embodiment, according to FIGS. 1 and 2, the return port (8') is at the output gas line (7) of the gas circulation circuit (5) and the heat exchanging coil (9) is arranged around the external region of the coldhead (1) along the whole extension of the coldhead (1).

In the embodiment of FIGS. 1 and 2, the cryocooler of the invention comprises means for deviating a small fraction of the internal cooling gas flow inside the coldhead (1) through the extraction orifice (8), perforated preferably on the expansion volume of the second stage (3). Preferably, the extraction orifice (8) has a typical diameter of 0.5-5.0 mm. The fraction of the gas flowing out of the gas circulation circuit (5) is conducted through a heat exchanging coil (9) which surrounds the coldhead (1) outer sleeve and connects the coldest second stage (3) at the bottom of the coldhead (1) (coldest point) with the top region of the coldhead (1) at the first stage (2) (warmest point).

Figure 3:
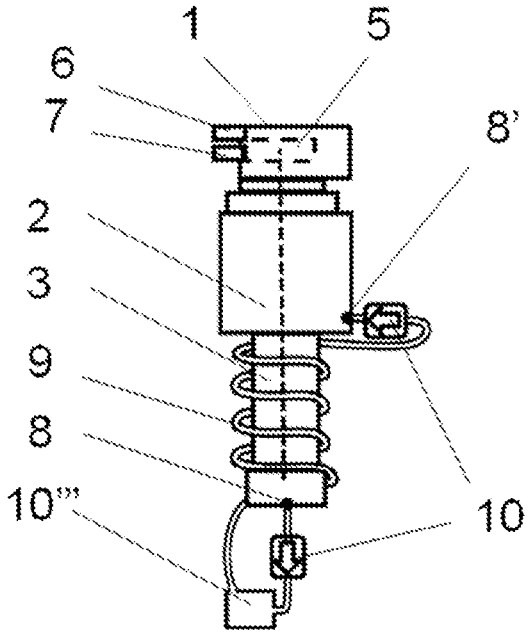
FIG. 3 shows a schematic diagram of a preferred embodiment of the cryocooler, wherein the heat exchanging coil is arranged around the second refrigeration stage of the coldhead, with the return port at the end of the first refrigeration stage, according to the invention.
Figure 4:
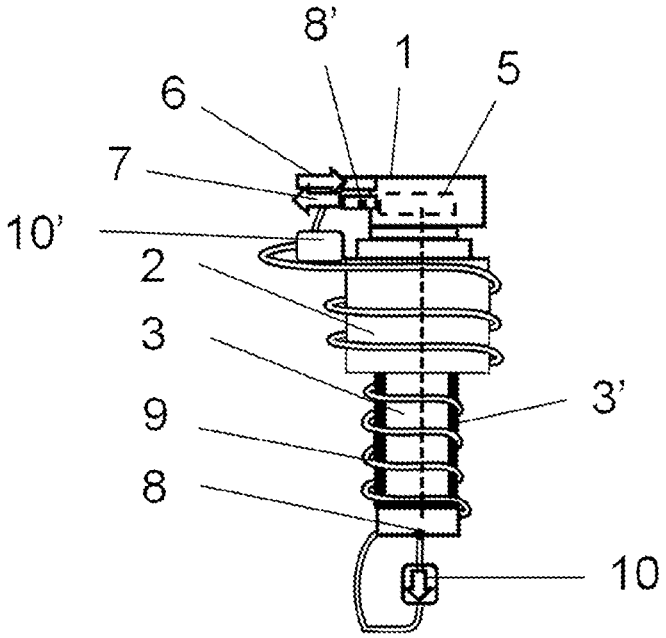
FIGS. 4-6 show a schematic diagram of a preferred embodiment of the cryocooler, wherein the heat exchanging coil is arranged around all the refrigeration stages of the coldhead, with the return port at the gas output line and wherein the thermally insulating layer is arranged around the coldest refrigeration stage (FIG. 4), around the warmest refrigeration stage (FIG. 5) or around all the refrigeration stages (FIG. 6), according to the invention.

In yet another embodiment, according to FIG. 3, the return port (8') is located at the coldhead (1) itself and the heat exchanging coil (9) is arranged around the second refrigeration stage (3) but not around the first refrigeration stage (2) of the coldhead (1). Particularly, said extraction orifice (8) is at the end of the second refrigeration stage (3) (coolest point) and said return port (8') is at the end of the first refrigeration stage (2) of the coldhead (1). As the gas inside the second refrigeration stage (3) is the coolest in this embodiment, the regenerator in the second refrigeration stage (3) is the farthest from being ideal because its volumetric heat capacity is not very high compared with that of helium. Hence a relative larger extra cooling power from such gas is extracted from the gas inside through the heat exchanging coil (9), allowing the thermal exchange of said cool gas with the exterior thereof. Also, it is much more efficient for the main purpose of the invention (i.e., improving the liquefaction rate obtained through the cryocooler coldhead (1)), to extract the cold from the inside of the second refrigeration stage (3) (through the heat exchanging coil (9)) than to simply allow a thermal exchange between the external region of the coldhead (1) and the gas in the exterior thereof (without the presence of the heat exchanging coil (9)).

Thus, as described in preceding sections, the main advantage of the proposed cryocooler is that it takes advantage of the already cooled gas circulating inside the coldhead (1), causing a part of said cold gas to travel through the interior of the heat exchanging coil (9), located in an external region of the coldhead (1) winding around the refrigeration stages (2, 3) (FIG. 2) or around the second refrigeration stage (3) (FIG. 3). Also, the aforementioned route ends in a return port (8') at the gas output line (7) returning to the compressor (4) (FIG. 2) or ends in a return port (8') at the coldhead (1) itself (FIG. 3), thus maintaining closed the gas circuit of the cryocooler. In this way, the helium (or other) cold gas that circulates inside the heat exchanging coil (9) contributes to refrigerate the outside region of the coldhead (1) but without exchanging matter (helium or other) with the exterior thereof. In this manner, it is possible to extract near 100% of the extra cooling power of the second stage regenerator.

In yet another embodiment, a thermally insulating layer (2', 3') (FIGS. 4-7) is disposed around the coldhead (1), between the heat exchanging coil (9) and the coldhead (1). In this manner, the thermal exchange between the heat exchanging coil (9) and the gas that is to be liquefied is optimized, whereas the coldhead (1) is working mainly in order to cool the gas inside said coldhead (1). In this manner, the rate of liquefaction of the gas can be improved.

Figure 7:
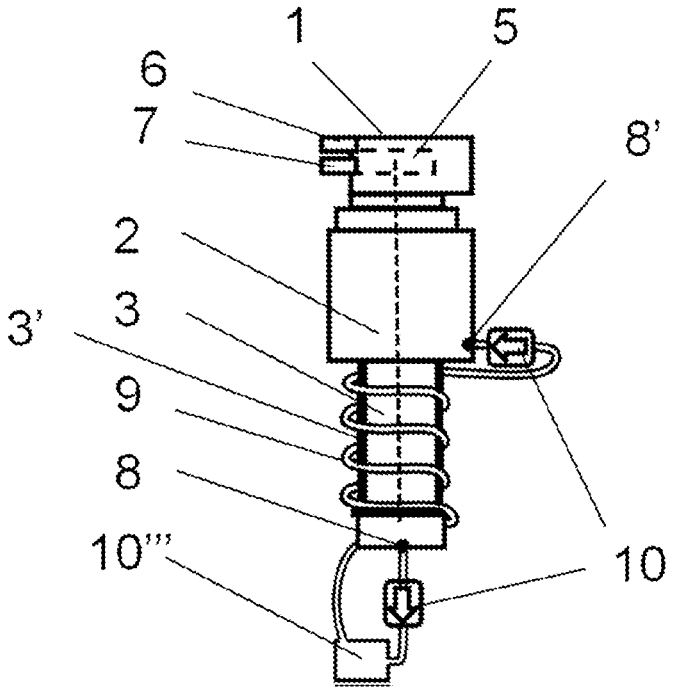
FIG. 7 shows a schematic diagram of a preferred embodiment of the cryocooler, wherein the heat exchanging coil is arranged around the second refrigeration stage of the coldhead, with the return port at the end of the first refrigeration stage and wherein the thermally insulating layer is arranged around the second refrigeration stage

In the embodiments where the heat exchanging coil (9) is arranged around the second refrigeration stage (3) of the coldhead (1), with the return port (8') at the end of the first refrigeration stage (2) (FIG. 3), the thermally insulating layer (3') is preferably disposed around the second refrigeration stage (3) (FIG. 7). As the excess cooling power of the regenerator inside the second refrigeration stage (3) is much larger than the excess cooling power of the regenerator inside the first refrigeration stage (2), isolating said second refrigeration stage (3) makes a large difference (in exploiting the cooling power for only cooling the gas inside).

Figure 5:
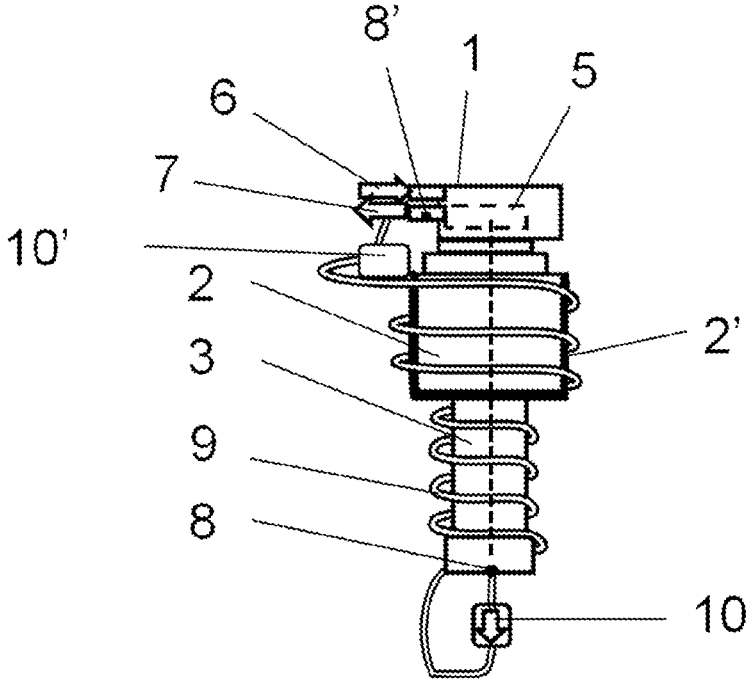
Figure 6:
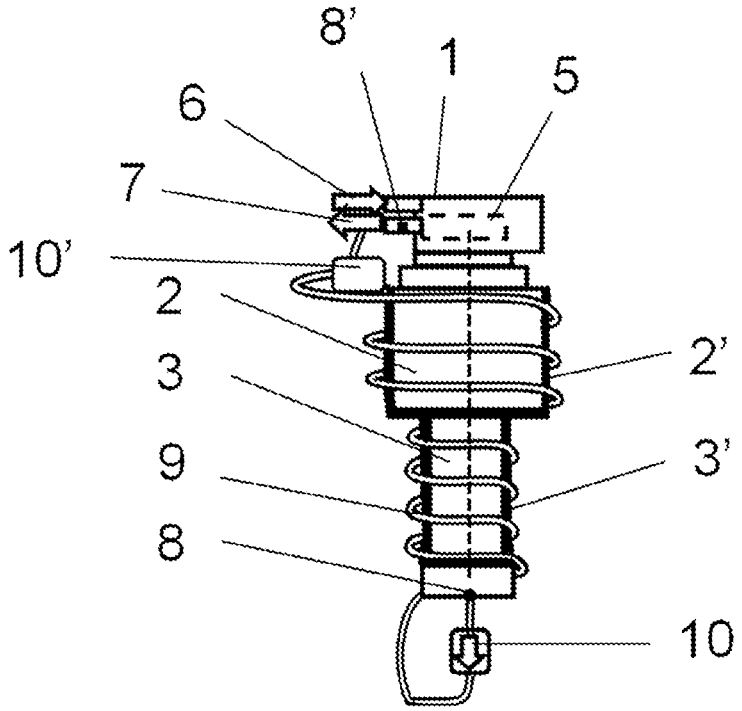

Alternatively, the thermally insulating layer (2') is preferably disposed around the first refrigeration stage (2) (FIG. 5).

As shown in FIGS. 4-7, with the using of a thermally insulating layer (2', 3'), it is possible to have a better control of the application of the cooling power of the coldhead (1) and, particularly, of the cooling power of each one of the refrigeration stages (2, 3) by selecting the portion of the external surface of the coldhead (1) that is thermally isolated. In this manner, it is possible to exploit the cooling power for cooling the gas inside the coldhead (1) or for extracting a part of the cooling power to the outside of the coldhead (1) through its walls. Note that the way the present invention takes advantage of the cooling power is a completely different approach in order to exploit the cooling power of a coldhead (1) if compared to typical cryocoolers that work in vacuum, because the last cannot exploit or configure coldheads for this purpose, as there is no such thermal exchange with the exterior thereof, except for the typical thermal exchange at the coldest end of the coldheads, wherein a thermally conducting block is in direct contact with the recipient or tube containing the gas to be liquefied.

In the embodiment corresponding to FIG. 2, the extraction of gas from the cold head (1) for its circulation through the heat exchanging coil (9) is preferably carried out by means of a cryogenic flow valve (10), connected to the extraction orifice (8), which communicates the gas circulation circuit (5) inside the coldhead (1) with the external region of the cooling stages (2, 3). The cryogenic flow valve (10) is preferably placed at one end of the heat exchanging coil (9), immediately after the perforated orifice/s (8). More preferably, the cryogenic flow valve (10) is a mechanical check valve.

In this manner, it is possible to regulate the amount of gas that is to be extracted from the coldhead (1) and flows through the heat exchanger coil (9), returning eventually to the compressor (4). Therefore, the extraction orifice (8) and the cryogenic flow valve (10) act as a passage port, which allows the gas inside the cold head (1) to flow out to the heat exchanging coil (9) and exchange heat with the region outside the coldhead (1).

The pass-through extraction orifice (8) can be performed over one or more of the refrigeration stages (2, 3) of the coldhead (1) by means of screws, rivets or analogous fixing means and they can also comprise insulating seals or joints to prevent undesired gas flow there through. The connection between the heat exchanging coil (9) and the output gas line (7) of the gas circulation circuit (5) can also comprise a mass flow controller (10') as well as other elements such as insulating seals or joints.

Another object of the invention, also according to FIG. 1, refers to a liquefaction system (11) that comprises a cryocooler according to any of the embodiments described in the preceding paragraphs. The liquefaction system (11) further comprises an isolated storage container (12) or Dewar comprising a liquid storage portion (13) and a neck portion (14) extending therefrom, and connected to an outer vessel (15) which is typically at ambient temperature. The storage container (12) is insulated by a shell (16) with the volume within the shell (16) being external to the storage portion (13) and substantially evacuated of air. Also, in order to measure the volume of liquid within the storage container (12), the system can optionally include a level meter (12').

Alternatively to the embodiment of FIG. 1, the mass flow controller (10') can be located in the neck portion (14) of the Dewar (12), in the gas circulation circuit (5) or even, in yet another embodiment of the invention, the cryogenic flow valve (10) can be an electronic valve comprising a mass flow controller (10') or an equivalent element as well.

In the embodiment according to FIG. 3, there are two cryogenic valves (10) connected to the heat exchange coil (9), one immediately after the extraction orifice (8) and another cryogenic valve (10) immediately before the return port (8') at the first refrigeration stage (2). Optionally, between both cryogenic valves (10) and connected to them, there is also disposed a control volume (10"). Said valves (10) and control volume (10'") are configured so that the flow inside the heat exchanging coil (9) goes only in one direction, from the extraction orifice (8) to the return port (8') and not backwards, and the flow rate is adjusted to an optimum value.

The storage portion (13) is adapted to contain a liquefied gas bath (17) at the bottom of the storage container (12) and a liquefaction region (18) above said bath (17), wherein the gas to be liquefied exchanges heat with the liquefaction system. In order to do so, the neck portion (14) is adapted to at least partially receive the cryocooler coldhead (1). As previously disclosed, the coldhead (1) may comprise one or more refrigeration stages (2, 3), each preferably having a distinct cross section. In different embodiments of the invention, the cryocooler can be either of the Gifford-McMahon (GM) or pulse-tube (PT) type.

The neck portion (14) of the storage container (12) may be optionally adapted to geometrically conform to the one or more refrigeration stages (2, 3) of the cryocooler coldhead (1), preferably in a stepwise manner. The storage container (12) further comprises a transfer port (12") extending from the liquid storage portion (13) to an external surface of the storage container (12).

A forward pressure control mechanism (19) that integrates a mass flow meter and a proportional valve (FPC) is further provided for controlling gas flow and thereby pressure within the liquefaction region (18) of the storage container (12). The forward pressure control mechanism (19) generally includes a pressure regulator or other means for regulating pressure of gas entering the liquefaction region (18) of the storage container (12). The pressure control mechanism (19) also makes use of an external pressure sensor (20), or integrates it, for detecting pressure within the liquefaction region (18) of the storage container (12). In this regard, the pressure control mechanism (19) is further connected to a computer Programmable Logic Controller (PLC) (21) (or equivalently, any suitable computing or processing means) for dynamically modulating input gas flow, and hence, pressure within the liquefaction region (18) of the storage container (12) for yielding optimum efficiency. Preferably, the PLC (21) is also connected to the refrigerator compressor (4) for controlling the pressure within the coldhead (1).

It should be recognized that although depicted as a distinct unit in several descriptive embodiments herein, the components of the pressure control mechanism (19) can be individually located near other system components and adapted to effectuate a similar liquefaction process. Accordingly, the pressure control mechanism (19) is intended to include a collection of components in direct attachment or otherwise collectively provided within the system for dynamically controlling input gas flow, and thus pressure within the liquefaction region (18) of the storage container (12).

As referred in preceding sections, in the present liquefaction system (11) the coldhead (1) comprising one or more stages (2, 3) operates in the neck portion (14) of the storage container (12) or Dewar. A first stage (2) is the warmest and operates in the neck portion (14) farther from the liquefaction region (18) than the other stages (3). Thus, the gas enters at the warm end of the neck portion (14) and is pre-cooled by the walls of the first stage (2) of the coldhead (1), by the coldest end of the first stage (2), further pre-cooled by the walls of the colder stages (3), and is then condensed at the coldest end of the coldest stage (3) of the coldhead (1). For a one-stage coldhead (1) embodiment, the condensation occurs at the coldest end of the first stage (2). Once condensed, the liquefied gas falls by gravity from the liquefaction region (18) down to the bath (17) at the bottom of the storage portion (13) in the interior of the storage container (12). The cooling power that each stage (2, 3) of a closed-cycle cryocooler generates, is determined mainly by its temperature, but also depends to second order on the temperature of the previous stages (2, 3). This information is generally supplied by the cryocooler manufacturer as a two-dimensional load map that plots the dependence of the power of the first (2) and second (3) stages versus the temperatures of the first and second stages (2, 3).

In addition to generating cooling power at the first (2) and second (3) stages, the coldhead (1) also generates cooling power along its entire length, in particular along the surface of the cylindrical so called "cold finger" between room temperature and the coldest end of the first stage (2), and along the length of the cylindrical "cold finger" between the stages (2, 3).

The liquefaction system (11) also comprises the refrigerator compressor (4) for distributing compressed gas inside the coldhead (1), wherein said gas is supplied to and returned from the coldhead (1) via the gas circulation circuit (5) and the heat exchanging coil (9) which are connected to the input (6) and output (7) gas lines of the compressor (4) for supplying and returning the pressurized gas which act as refrigeration means for lowering the temperature of the refrigeration stages (2, 3). In known small-scale helium liquefiers, the supply pressures are typically between 1.5-2.5 MPa and the return pressures are typically between 0.3-1 MPa. The distributed gas inside the compressor (4) can be different or of the same type of the gas to be liquefied (for example, helium).

The system of the invention is preferably supplied with gas from a gas source module (22), preferably being recovered gas from a cryogen-using equipment. The gas source module (22) is connected to the storage container (12) and preferably controlled by the pressure control mechanism (19). The condensation process of the cold vapor accumulating as liquid in the storage container (12) corresponds to an isobaric process during which any disturbance in pressure yields a diminished liquefaction rate. For the gas liquefaction system to perform at optimum efficiency, it is therefore necessary to perform precise control of the interior pressure conditions, maintaining it throughout the entire process.

With the aim of improving the known liquefaction systems in the state of the art, it is also an object of this invention to optimize the heat exchange between the gas and the various refrigeration elements of the liquefaction system (11), as well as obtaining further auxiliary means for improving the liquefaction rate obtained through the cryocooler coldhead (1).

In order to carry out the said object, the system (11), through the heat exchanger coil (9), takes advantage of the already refrigerated gas circulating inside de coldhead (1), by extracting a small amount thereof, and conducting it through the inside of the heat exchanging coil (9), located in a portion of the neck (14) of the Dewar (12), winding around the refrigeration stages (2, 3). In this way, the refrigerated gas, preferably helium, that circulates inside the heat exchanger coil (9) contributes to the liquefaction of the helium that gets inside the Dewar (12), thereby increasing the average liquefaction rate of the system (11) while maintaining the pressure inside the storage container (12) at a constant value by means of the gas source module (22), the pressure control mechanism (19), the pressure sensor (20) and/or the PLC (21).

The most remarkable advantage of this solution is that it avoids the transfer of matter (helium gas) in the liquefaction process. In this manner, other complexities required in the prior art (as supplementary high-purity and high pressure gas sources connected to the gas circulation circuit (5)) are avoided.

When referring to "small volumes" of gas extracted from the coldhead (1), without altering its functioning, these should be interpreted, within the scope of the invention, as volumes which do not alter the refrigeration operations or capacities of the compressor (4) over the coldhead (1) stages (2, 3), maintaining the temperature of the coldest stage (3) of the coldhead (1) stable, preferably at a constant value of substantially 4.2 K for the case of helium liquefaction applications.

In another general embodiment, a method for liquefaction of gas is provided in conjunction with the described liquefaction system (11) of the invention that comprises a cryocooler as previously described in the present application.

The method preferably comprises the following steps:

(i) Providing at least:

a storage container (12) having a liquefaction region (18) and defined by a storage portion (13) and a neck portion (14) extending therefrom;

a pressure control mechanism (19) for controlling the pressure within the liquefaction region (18) of the storage container (12);

a cryocooler coldhead (1) at least partially disposed within the neck portion (14), the coldhead (1) being adapted to condense a cryogen contained within the liquefaction region (18) from a gas-phase to a liquid phase;

optionally, a gas source module (22) containing an amount of gas-phase cryogen;

wherein the cryocooler coldhead (1) comprises:

a refrigerator compressor (4) for distributing compressed gas-phase cryogen inside the coldhead (1), wherein said cryogen is supplied to and returned from the coldhead (1) and acts as refrigeration means for lowering the temperature of one or more refrigeration stages (2, 3) of the coldhead (1);

a heat exchanging coil (9) arranged around the external region of the refrigeration stages (2, 3) of the coldhead (1);

one or more extraction orifices (8) communicating a gas circulation circuit (5) inside the coldhead (1) with the heat exchanger coil (9), acting as pass-through ports which allow the gas inside the coldhead (1) to flow through the inside of the heat exchanging coil (9) for exchanging heat with the gas in the liquefaction region (18) of the storage container (12); and wherein the heat exchanging coil (9) is adapted to connect and redirect the gas to a return port (8') connected to the gas circulation circuit (5), such as a return port (8') in the output gas line (7) of the refrigerator compressor (4) or a return port (8') at the coldhead (1).

connecting a PLC (21) to the refrigerator compressor (4) for controlling the pressure within the coldhead (1).

(ii) Measuring and controlling the vapor pressure within said liquefaction region (18) of the storage container (12) with the pressure control mechanism (19), and optionally the internal pressure within the coldhead (1) with the PLC (21).

(iii) Maintaining the vapor pressure within said liquefaction region (18) of the storage container (12) by means of the pressure control mechanism (19), and optionally maintaining the internal pressure within the coldhead (1) within an operating range by means of the PLC (21).

(iv) Optionally, injecting gas into the liquefaction region (18) of the storage container (12) with a gas source module (22) in collaboration with the pressure control mechanism (19) for maintaining the vapor pressure during step (iii).

Although in principle the present invention allows the use of any multi-stage cryocooler coldhead (1), the following description is directed to an embodiment comprising a coldhead (1) with two refrigeration stages (2, 3). Nonetheless, it should be apparent to the person skilled in the art that the application to other types of cryocoolers (comprising a coldhead (1) equipped with one, two, or more refrigeration stages (2, 3)) is analogously achievable with equivalent increase in the liquefaction rates.

To sum up, the present invention proposes a cryocooler, a liquefaction system (11) and a liquefaction method which allow extracting increased extra cooling power from the low temperature regenerator of the coldhead (1), thus, enhancing the refrigeration capacities thereof, for different gas cooling and liquefaction applications.

The invention claimed is:

1. A cryocooler for gas liquefaction applications, the cryocooler comprising:

a coldhead with one or more refrigeration stages;

a refrigerator compressor for distributing a compressed cryogen gas inside the coldhead, lowering the temperature of the one or more refrigeration stages, wherein said compressed cryogen gas is supplied to and returned from the coldhead through a gas circulation circuit comprising an input gas line and an output gas line, which connect the coldhead with the refrigerator compressor;

at least one extraction orifice communicating the gas circulation circuit inside the coldhead with an external region of the one or more refrigeration stages, acting as a pass-through port which allows the gas inside the coldhead to flow to the exterior thereof; and an input gas source configured to supply cryogen gas to the refrigerator compressor through the gas circulation circuit, wherein the input gas source comprises a heat exchanging coil arranged around an external region of the coldhead and spaced from said external region such that the heat exchanging coil and the coldhead are at least partially thermally isolated from each other;

wherein the heat exchanging coil is connected at a first end to the gas circulation circuit through the at least one extraction orifice, and at a second end to one return port connected to said gas circulation circuit, such that the compressed cryogen gas flows from the first end of the heat exchanging coil to the second end of the heat exchanging coil, and wherein said return port is arranged at the output gas line between the coldhead and the refrigerator compressor.

2. The cryocooler of claim 1, wherein the return port is arranged at the coldhead.

3. The cryocooler of claim 1, wherein the heat exchanging coil and the external region coldhead are spaced by a thermally insulating layer arranged between the heat exchanging coil and the external region of the coldhead.

4. The cryocooler of claim 1, wherein the heat exchanging coil is connected to the extraction orifice and/or to the return port through one or more of the following elements: one or more cryogenic flow valves, a mass flow controller valve, a control volume, a capillary tube, an insulating seal and/or one or more joints.

5. The cryocooler of claim 1, wherein the at least one extraction orifice has a diameter of 0.5-5.0 mm.

6. The cryocooler of claim 1, wherein the at least one extraction orifice is fixed to the one or more refrigeration stages of the coldhead.

7. The cryocooler of claim 1, wherein the pass-through port comprises a cryogenic flow valve.

8. The cryocooler of claim 1, wherein the refrigerator compressor is connected to a Programmable Logic Controller (PLC) for controlling the pressure within the coldhead, and/or wherein the compressed cryogen gas is helium.

9. A cryogen-gas liquefaction system comprising:

the cryocooler of claim 1;

a storage container comprising a liquid storage portion and a neck portion extending therefrom, the liquid storage portion being adapted to contain a liquefied gas bath at the bottom of the storage container, and wherein said storage container comprises a liquefaction region above said bath, wherein a cryogen is contained in said liquefaction region;

a gas pressure control mechanism for controlling the cryogen gas pressure within the liquefaction region of the storage container; and a PLC connected to the refrigerator compressor, for controlling the pressure within the coldhead;

wherein the coldhead of the cryocooler is arranged at the neck portion of the storage container, so that the compressed cryogen gas circulating through the inside of the heat exchanging coil of the cryocooler can exchange heat with the cryogen inside the liquefaction region of the storage container, such that the cryocooler is adapted to condense the cryogen contained within the liquefaction region of the storage container from a gas-phase to a liquid-phase.

10. The cryocooler of claim 6, wherein the fixing of the at least one extraction orifice to the one or more refrigeration stages of the coldhead is combined with insulating seals to prevent undesired gas flow through said fixing.

11. The cryogen-gas liquefaction system of claim 9, wherein the cryocooler further comprises the input gas source configured to supply cryogen gas to the refrigerator compressor through the gas circulation circuit.

12. The cryogen-gas liquefaction system of claim 9, further comprising a gas source module containing an amount of gas-phase cryogen for the introduction of said gas-phase cryogen into the liquefaction region of the storage container.

13. The cryogen-gas liquefaction system of claim 9, wherein the cryogen contained in the liquefaction region of the storage container and/or the compressed cryogen gas is helium, nitrogen, oxygen, hydrogen or neon.

14. A cryogen-gas liquefaction method for use in the cryogen-gas liquefaction system of claim 9, wherein the cryogen-gas liquefaction method comprises:

(i) providing the cryogen-gas liquefaction system, wherein the coldhead of the cryocooler is at least partially disposed within the neck portion of the storage container, and is adapted to condense the cryogen contained within the liquefaction region of the storage container from a gas-phase to a liquid-phase;

(ii) measuring and controlling the vapor pressure within said liquefaction region of the storage container with the pressure control mechanism and the PLC; and (iii) maintaining the vapor pressure within said liquefaction region of the storage container with the pressure control mechanism.

15. The cryogen-gas liquefaction system of claim 11, wherein the input gas source comprises the heat exchanging coil arranged around the external region of the coldhead of the cryocooler, and wherein said heat exchanging coil is connected at the first end to the gas circulation circuit through the at least one extraction orifice, and at the second end to the one return port connected to said gas circulation circuit, such that the compressed cryogen gas flows from the first end of the heat exchanging coil to the second end of the heat exchanging coil, so that the compressed cryogen gas circulating through the inside of the heat exchanging coil can exchange heat with the cryogen inside the liquefaction region of the storage container.

16. The cryogen-gas liquefaction system of claim 12, wherein the gas source module contains helium gas, recovered and/or purified from a helium-using equipment.

17. The cryogen-gas liquefaction method of claim 14, wherein step (ii) further comprises measuring the internal pressure within the coldhead and step (iii) further comprises maintaining said pressure of the coldhead with the PLC.

18. The cryogen-gas liquefaction method of claim 14, further comprising the step of injecting gas into the liquefaction region of the storage container with a gas source module, in collaboration with the gas pressure controller for maintaining the vapor pressure during step (iii).

* * * * *